US011560613B2

(12) United States Patent
Sakamoto et al.

(10) Patent No.: US 11,560,613 B2
(45) Date of Patent: Jan. 24, 2023

(54) MARTENSITIC STAINLESS STEEL

(71) Applicant: DENSO CORPORATION, Kariya (JP)

(72) Inventors: Mirai Sakamoto, Kariya (JP); Yoshihiro Tanimura, Kariya (JP); Shigeyuki Kusano, Kariya (JP); Noritsugu Kato, Kariya (JP); Yuki Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 87 days.

(21) Appl. No.: 17/083,391

(22) Filed: Oct. 29, 2020

(65) Prior Publication Data

US 2021/0047715 A1 Feb. 18, 2021

Related U.S. Application Data

(63) Continuation of application No. PCT/JP2019/016501, filed on Apr. 17, 2019.

(30) Foreign Application Priority Data

May 11, 2018 (JP) ..... JP2018-092136

(51) Int. Cl.

| | |
|---|---|
| ***C22C 38/44*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/46*** | (2006.01) |

(52) U.S. Cl.

CPC ..... *C22C 38/44* (2013.01); *C21D 8/0205* (2013.01); *C22C 38/001* (2013.01); *C22C 38/002* (2013.01); *C22C 38/02* (2013.01); *C22C 38/04* (2013.01); *C22C 38/42* (2013.01); *C22C 38/46* (2013.01); *C21D 2211/008* (2013.01)

(58) Field of Classification Search

CPC ..... C22C 38/44; C22C 38/001; C22C 38/002; C22C 38/02; C22C 38/04; C22C 38/42; C22C 38/46; C22C 38/20; C22C 38/22; C22C 38/24; C22C 38/40; C21D 8/0205; C21D 2211/008; F02M 59/445; F02M 61/166; F02M 2200/9053

See application file for complete search history.

(56) References Cited

U.S. PATENT DOCUMENTS

| | | | | |
|---|---|---|---|---|
| 9,982,545 | B2 * | 5/2018 | Hirakawa | C21D 6/008 |
| 2010/0001215 | A1 | 1/2010 | Suzuki et al. | |

FOREIGN PATENT DOCUMENTS

| | | | |
|---|---|---|---|
| DE | 694 13 632 T2 | | 5/1999 |
| EP | 0 638 658 | | 7/1994 |
| JP | 2003041348 A | * | 2/2003 |
| JP | 2008-133499 | | 6/2008 |
| JP | 2010-144204 | | 7/2010 |

* cited by examiner

*Primary Examiner* — Daniel J. Schleis
*Assistant Examiner* — Kevin C T Li
(74) *Attorney, Agent, or Firm* — Nixon & Vanderhye P.C.

(57) ABSTRACT

A martensitic stainless steel contains 0.20 mass %≤C≤0.60 mass %, 0.10 mass %≤N≤0.50 mass %, 14.00 mass %≤Cr≤17.00 mass %, 1.00 mass %≤Mo≤3.00 mass %, 0.20 mass %≤V≤0.40 mass %, Si≤0.30 mass %, Mn≤0.80 mass %, P≤0.040 mass %, S≤0.040 mass %, Cu≤0.25 mass %, Ni≤0.20 mass %, and the balance Fe with inevitable impurities.

4 Claims, 3 Drawing Sheets

WHEN L1 > L2
IN A CASE WHERE d1 < L2 → LENGTH LX = L1 + d1 + L2
IN A CASE WHERE d1 ≥ L2 → LENGTH LX = L1

WHEN L2 > L3
IN A CASE WHERE d2 < L3 → d2 AND L3 ARE INCLUDED IN LENGTH LX
IN A CASE WHERE d2 ≥ L3 → d2 AND L3 ARE NOT INCLUDED IN LENGTH LX

FIG. 5

| | | COMPARATIVE EXAMPLE 1 | EXAMPLE 1 | EXAMPLE 2 | EXAMPLE 3 | COMPARATIVE EXAMPLE 2 | COMPARATIVE EXAMPLE 3 | COMPARATIVE EXAMPLE 4 |
|---|---|---|---|---|---|---|---|---|
| COMPONENTS [mass%] | Fe | BALANCE | BALANCE | BALANCE | BALANCE | BALANCE | BALANCE | BALANCE |
| | C | 0.10 | 0.37 | 0.4 | 0.43 | 0.41 | 0.42 | 0.66 |
| | Si | 0.23 | 0.21 | 0.23 | 0.24 | 0.27 | 0.29 | 0.27 |
| | Mn | 0.41 | 0.4 | 0.41 | 0.40 | 0.40 | 0.37 | 0.72 |
| | P | 0.002 | 0.02 | 0.022 | 0.021 | 0.021 | 0.015 | 0.021 |
| | S | 0.001 | 0.001 | 0.001 | 0.001 | 0.001 | 0.003 | 0.001 |
| | Cu | 0.02 | 0.02 | 0.02 | 0.02 | 0.02 | 0.00 | 0.00 |
| | Ni | 0.13 | 0.12 | 0.12 | 0.12 | 0.13 | 0.18 | 0.00 |
| | Cr | 15.69 | 15.7 | 15.69 | 15.43 | 15.48 | 11.61 | 12.84 |
| | Mo | 1.67 | 1.67 | 1.67 | 1.67 | 1.65 | 1.18 | 0.00 |
| | V | 0.27 | 0.28 | 0.27 | 0.28 | 0.27 | 0.14 | 0.00 |
| | N | 0.14 | 0.14 | 0.14 | 0.13 | 0.14 | 0.21 | 0.00 |
| LENGTH OF COMPOUND GROUP [μm] | | 0 | 30 | 19 | 45 | 124 | 140 | 30 |
| VICKERS HARDNESS [Hv] | | NO GOOD (150) | GOOD (652) | GOOD (660) | GOOD (668) | GOOD (660) | GOOD (673) | GOOD (672) |
| RESULT OF CORROSION TEST | | GOOD | GOOD | GOOD | GOOD | NO GOOD | NO GOOD | NO GOOD |

MARTENSITIC STAINLESS STEEL

CROSS REFERENCE TO RELATED APPLICATIONS

The present application is a continuation application of International Patent Application No. PCT/JP2019/016501 filed on Apr. 17, 2019, which designated the U.S. and claims the benefit of priority from Japanese Patent Application No. 2018-092136 filed on May 11, 2018. The entire disclosures of all of the above applications are incorporated herein by reference.

TECHNICAL FIELD

The present disclosure relates to a martensitic stainless steel.

BACKGROUND

Conventionally, martensitic stainless steels having high strength and high corrosion resistance have been known.

SUMMARY

The present disclosure provides a martensitic stainless steel containing 0.20 mass %≤C≤0.60 mass %, 0.10 mass %≤N≤0.50 mass %, 14.00 mass %≤Cr≤17.00 mass %, 1.00 mass %≤Mo≤3.00 mass %, 0.20 mass %≤V≤0.40 mass %, Si≤0.30 mass %, Mn≤0.80 mass %, P≤0.040 mass %, S≤0.040 mass %, Cu≤0.25 mass %, Ni≤0.20 mass %, and the balance Fe with inevitable impurities.

BRIEF DESCRIPTION OF DRAWINGS

Objects, features and advantages of the present disclosure will become apparent from the following detailed description made with reference to the accompanying drawings. In the drawings:

FIG. 5 is a diagram showing component amounts and the like of examples and comparative examples.

DETAILED DESCRIPTION

Figure 1A:
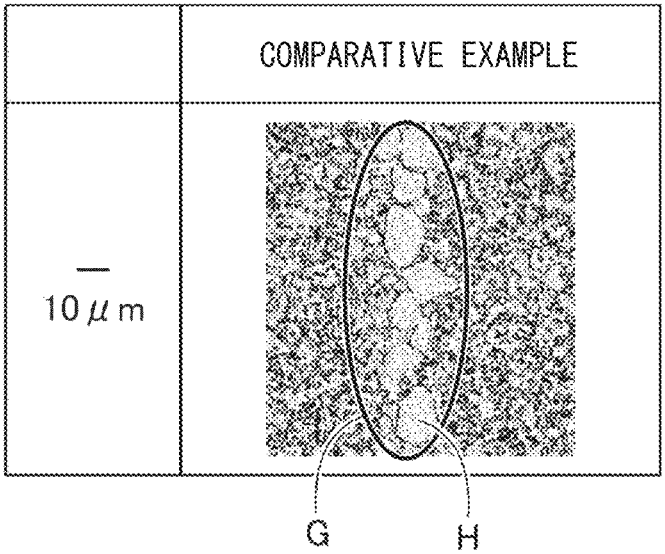
FIG. 1A is a cross-sectional view of a martensitic stainless steel according to a comparative example.

Conventional martensitic stainless steels have insufficient corrosion resistance to be used in a severe corrosive environment such as an atmosphere in which a strong acid such as sulfuric acid or nitric acid is present. Therefore, a martensitic stainless steel having high strength and excellent corrosion resistance even in a severe corrosive environment has been desired.

According to one aspect of the present disclosure, a martensitic stainless steel contains 0.20 mass %≤C≤0.60 mass %, 0.10 mass %≤N≤0.50 mass %, 14.00 mass %≤Cr≤17.00 mass %, 1.00 mass %≤Mo≤3.00 mass %, 0.20 mass %≤V≤0.40 mass %, Si≤0.30 mass %, Mn≤0.80 mass %, P≤0.040 mass %, S≤0.040 mass %, Cu≤0.25 mass %, Ni≤0.20 mass %, and the balance Fe with inevitable impurities.

The martensitic stainless steel according to the above aspect has high strength and excellent corrosion resistance even in a severe corrosive environment.

(Embodiment)

A martensitic stainless steel according to a present embodiment contains the following elements, and the balance Fe with inevitable impurities. In the present specification, the martensitic stainless steel refers to a stainless steel containing 50 mass % or more martensite at room temperature (25° C.). Hereinafter, the elements contained in the martensitic stainless steel of the present embodiment will be described.

$$0.20 \text{ mass } \% \leq C \leq 0.60 \text{ mass } \% \quad (1)$$

C is very effective in achieving high hardness, and the martensitic stainless steel contains 0.20 mass % or more C. However, when the content of C exceeds 0.60 mass %, segregation of components during solidification is promoted. As a result, a corrosion resistance deteriorates when used in a severe corrosive environment such as an atmosphere in which a strong acid such as sulfuric acid or nitric acid is present. Therefore, the content of C is from 0.20 mass % to 0.60 mass % both inclusive. From the viewpoint of achieving high hardness, the content of C is preferably 0.30 mass % or more. On the other hand, from the viewpoint of ensuring the corrosion resistance, the content of C is preferably 0.50 mass % or less.

$$0.10 \text{ mass } \% \leq N \leq 0.50 \text{ mass } \% \quad (2)$$

Since N has an extremely high solid solution strengthening ability and is effective in corrosion resistance, the martensitic stainless steel contains 0.10 mass % or more N. However, when the content of N exceeds 0.50 mass %, the segregation of components during solidification is promoted as in the case of C. As a result, the corrosion resistance deteriorates when used in a severe corrosive environment such as an atmosphere in which a strong acid such as sulfuric acid or nitric acid is present. Therefore, the content of N is from 0.10 mass % to 0.50 mass % both inclusive. From the viewpoint of achieving high hardness, the content of N is preferably 0.2 mass % or more. On the other hand, from the viewpoint of improving the corrosion resistance, the content of N is preferably 0.40 mass % or less.

$$0.30 \text{ mass } \% \leq C+N \leq 0.80 \text{ mass } \% \quad (3)$$

From the viewpoint of achieving high hardness while improving the corrosion resistance, the sum of the contents of C and N is especially preferably from 0.30 mass % to 0.80 mass % both inclusive.

$$14.00 \text{ mass } \% \leq Cr \leq 17.00 \text{ mass } \% \quad (4)$$

Since Cr has an effect of increasing the solubility of N, the martensitic stainless steel contains 14.00 mass % or more Cr from the viewpoint of improving the hardness and the corrosion resistance. However, since Cr is a ferrite phase stabilizing element, Cr promotes the formation of δ ferrite, which leads to a decrease in strength and ductility. Therefore, the upper limit of the content of Cr is set to 17.00 mass %. Therefore, the content of Cr is from 14.00 mass % to 17.00 mass % both inclusive. From the viewpoint of improving the hardness and the corrosion resistance, the content of Cr is preferably 15.00 mass % or more. On the other hand, the content of Cr is preferably 16.00 mass % or less from the viewpoint of suppressing the amount of retained austenite from becoming excessive.

$$1.00 \text{ mass } \% \leq Mo \leq 3.00 \text{ mass } \% \quad (5)$$

Since Mo has an effect of increasing the solubility of N, the martensitic stainless steel contains 1.00 mass % or more Mo from the viewpoint of improving the hardness and the corrosion resistance. However, when the content of Mo exceeds 3.00 mass %, it becomes difficult to secure austenite phase. Therefore, the content of Mo is from 1.00 mass % to 3.00 mass % both inclusive. From the viewpoint of improving the hardness and the corrosion resistance, the content of Mo is preferably 1.50 mass % or more. On the other hand, from the viewpoint of securing the austenite phase, the content of Mo is preferably 2.50 mass % or less.

$$0.20 \text{ mass } \% \leq V \leq 0.40 \text{ mass } \% \quad (6)$$

V improves hardness by combining with C and N. Therefore, the martensitic stainless steel contains 0.2 mass % or more V. However, when the content of V exceeds 0.40 mass %, a large amount of carbides and nitrides remain in the martensitic stainless steel, resulting in a decrease in corrosion resistance. Therefore, the content of V is from 0.20 mass % to 0.40 mass % both inclusive. From the viewpoint of improving the hardness, the content of V is preferably 0.25 mass % or more. On the other hand, the content of V is preferably 0.35 mass % or less from the viewpoint of suppressing the residue of carbides and nitrides.

$$Si \leq 0.30 \text{ mass } \% \quad (7)$$

Si has a function of suppressing generation of oxides and nitrides. However, if the content of Si is excessive, the toughness and the ductility are lowered. Therefore, the content of Si in the martensitic stainless steel is 0.30 mass % or less.

$$Mn \leq 0.80 \text{ mass } \% \quad (8)$$

Mn is effective in increasing the solid solution amount of N. However, if the Mn content is excessive, the hardness is lowered. Therefore, the content of Mn in the martensitic stainless steel is 0.80 mass % or less.

$$P \leq 0.040 \text{ mass } \%,\ S \leq 0.040 \text{ mass } \% \quad (9)$$

P and S have a function of reducing the toughness and the ductility. On the other hand, reducing P and S more than necessary causes an increase in cost. Therefore, in the martensitic stainless steel, the content of P is 0.040 mass % or less and the content of S is 0.040 mass % or less.

$$Cu \leq 0.25 \text{ mass } \%,\ Ni \leq 0.20 \text{ mass } \% \quad (10)$$

Cu and Ni are austenite-forming elements, but if the contents of Cu and Ni are excessive, Cu and Ni have a function of increasing the amount of retained austenite. Therefore, in the martensitic stainless steel, the content of Cu is 0.25 mass % or less and the content of Ni is 0.20 mass % or less. The content of Cu is preferably 0.10 mass % or less, more preferably 0.05 mass % or less.

Figure 1B:
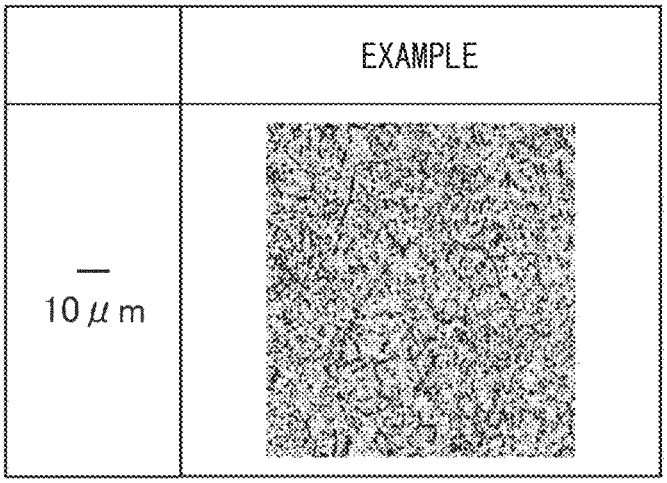
FIG. 1B is a cross-sectional view of a martensitic stainless steel according to an example of a present embodiment.

In the martensitic stainless steel of the present embodiment, a length of a compound group formed by connecting any one or more of metal carbide, metal nitride, and metal carbonitride is 80 μm or less. A metal concentration in a peripheral region of the compound group is smaller than a metal concentration in other region. As a result, in the peripheral region of the compound group, erosion progresses in a severe corrosive environment such as an atmosphere in which a strong acid such as sulfuric acid or nitric acid is generated. Therefore, it is more preferable that the length of the compound group is shorter, and in the martensitic stainless steel of the present embodiment, the length of the compound group is from 0 μm to 80 μm both inclusive. The length of the compound group is preferably 70 μm or less, more preferably 60 μm or less, still more preferably 50 μm or less. In the cross-sectional views of martensitic stainless steels according to an example of the present embodiment and a comparative example shown in FIG. 1A and FIG. 1B, each region closed by a boundary line shows any one of metal carbide, metal nitride, and metal carbonitride. For example, a region H shows any one of metal carbide, metal nitride, and metal carbonitride. Then, the compound group is present, for example, as shown in a region G shown in FIG. 1A. Hereinafter, a method for measuring the length of the compound group will be described. The length of the compound group is measured using a cross section of 1 $cm^2$ in the martensitic stainless steel.

Figure 2A:
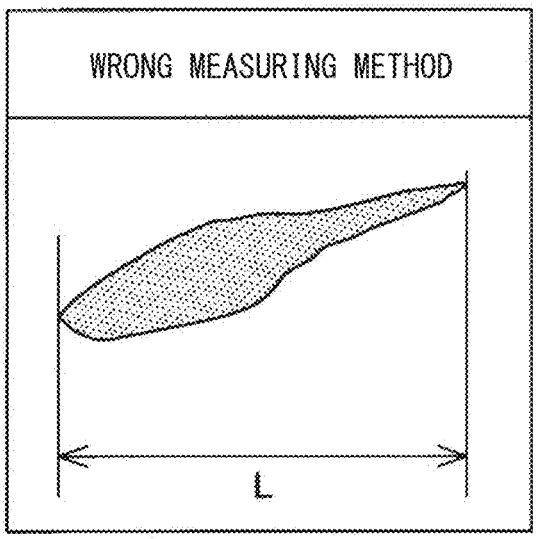
FIG. 2A is a diagram illustrating a wrong method for measuring a length L of metal carbide, metal nitride, and metal carbonitride.
Figure 2B:
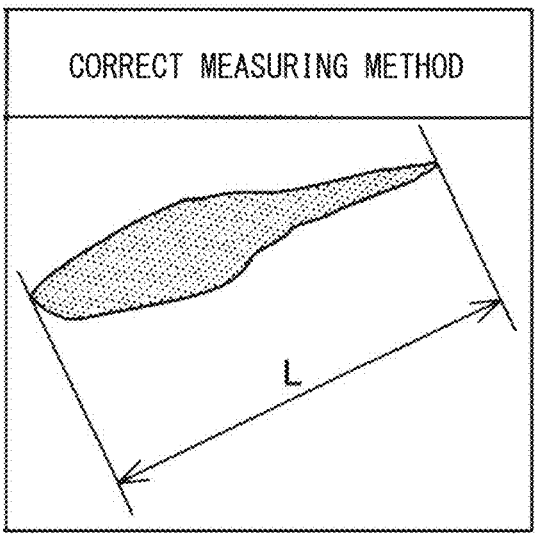
FIG. 2B is a diagram illustrating a correct method for measuring a length L of metal carbide, metal nitride, and metal carbonitride.
Figure 3:
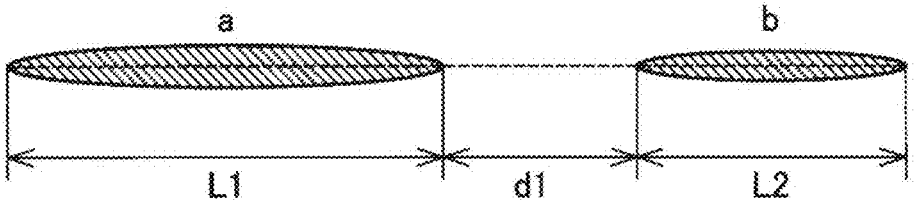
FIG. 3 is a diagram illustrating a method for measuring a length LX of a compound group formed by connecting any one or more of metal carbide, metal nitride, and metal carbonitride.

As shown in FIG. 2A and FIG. 2B, in the present specification, the length L of metal carbide, metal nitride and metal carbonitride means the maximum value of the length from one end to the other end. Then, as shown in FIG. 3, the length LX of the compound group formed by connecting any one or more of metal carbide, metal nitride, and metal carbonitride is measured on a cross section obtained by cutting out the martensitic stainless steel. When one or more compounds of metal carbide, metal nitride, and metal carbonitride are adjacent to each other, a method for measuring the length LX of the compound group differs depending on whether a distance d1 to the adjacent compound is equal to or greater than a length L2 of a shorter compound b between the lengths of the adjacent compounds. Between the lengths of adjacent compounds, a length of a longer compound a is L1.

Specifically, when the distance d1 to the adjacent compound is equal to or greater than the length L2 of the shorter compound b between the lengths of the adjacent compounds, that is, when d1≥L2, the length LX of the compound group is defined as L1. On the other hand, when the distance d1 to the adjacent compound is less than the length L2 of the shorter compound b between the lengths of the adjacent compounds, that is, when d1<L2, the length LX of the compound group is defined as the sum of L1, d1, and L2.

Figure 4:
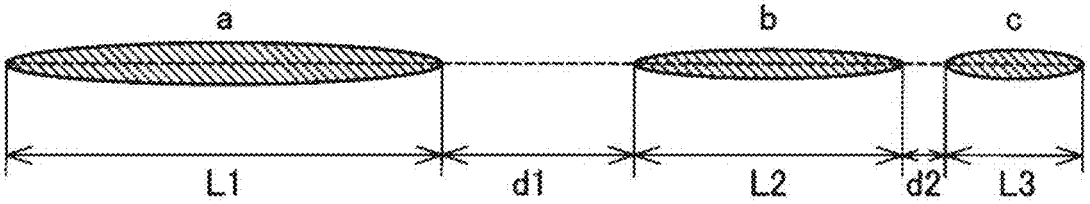
FIG. 4 is a diagram illustrating a method for measuring a length LX of a compound group in a case where three compounds are adjacent to each other.

Even when three compounds are adjacent to each other, a similar measurement method is used. As shown in FIG. 4, when a compound c adjacent to the compound b is present and a distance d2 to the adjacent compound is equal to or greater than a length L3 of the shorter compound c between the lengths of the adjacent compounds, that is, when d2≥L3, d2 and L3 are not included in the length LX of the compound group. On the other hand, when the distance d2 to the adjacent compound is less than the length L3 of the shorter compound c between the lengths of the adjacent compounds, that is, when d2<L3, L3 and d2 are included in the length LX of the compound group. For example, when L1>L2>L3, d1 is less than L2, and d2 is less than L3, the length LX of the compound group is the sum of L1, d1, L2, L3, and d2. The same shall apply when four or more compounds are adjacent to each other.

FIG. 5 shows components [mass %] of respective raw materials, lengths [μm] of compound groups, Vickers hardness [Hv], and corrosion test results of Examples and Comparative Examples. Manufacturing methods of Examples and Comparative Examples are shown below.

The tester first mixed respective raw materials so as to have the amount of the components shown in FIG. 5, and then melted, refined, and casted in this order to obtain a steel ingot. The tester performed an ESR (Electro-Slag Remelting process) on the obtained steel ingot and then subjected to a homogenization treatment. After that, the tester adjusted a material diameter by hot rolling and then promoted spheroidization by annealing treatment to obtain examples and comparative examples. The method of structure formation is not limited to ESR and homogenization treatment, and for example, a method of sintering powder or a MIM (metal powder injection molding method) may be used.

The Vickers hardness in FIG. 5 was measured in accordance with the Vickers hardness test of JIS Z 2244. In FIG. 5, a case where the Vickers hardness is 600 Hv or more is defined as "Good", and a case where the Vickers hardness is less than 600 is defined as "No Good". Here, the n number is 5, and the average value of the Vickers hardness is shown in parentheses.

The corrosion test in FIG. 5 was performed by measuring a maximum erosion depths in a cross sections of each sample after being immersed in a sulfuric acid solution having a pH of 2 for 24 hours. Here, the maximum erosion depth is the maximum value of the depth at which erosion has progressed from the surface of the sample. In FIG. 5, a case where the maximum erosion depth is less than 50 μm is defined as "Good", and a case where the maximum erosion depth is 50 μm or more is defined as "No Good".

As shown in FIG. 5, it was found that the examples had sufficiently high hardness and high corrosion resistance as compared with the comparative examples.

The martensitic stainless steel of the present embodiment can be used for various members such as vehicle members and airplane members. The martensitic stainless steel can be used for parts used in an atmosphere where strong acids such as sulfuric acid and nitric acid are generated, and examples of such parts include parts of an internal combustion engine. Further, the internal combustion engine includes an internal combustion engine that performs EGR (exhaust gas recirculation), and in the internal combustion engine that performs EGR, intake is performed again by taking in a part of the exhaust gas after combustion in the internal combustion engine. Therefore, in the internal combustion engine that performs EGR, sulfuric acid and nitric acid are generated from sulfur and nitrogen in the exhaust gas. Even in such an environment, the martensitic stainless steel of the present embodiment is preferably used. Specifically, the martensitic stainless steel of the present embodiment is suitably used for, for example, a fuel injection valve or a high-pressure pump. More specifically, the martensitic stainless steel of the present embodiment is suitably used for, for example, a needle, a body valve, and a core which are members of a fuel injection valve and can be exposed to sulfuric acid or nitric acid.

(Other Embodiments)

The present disclosure should not be limited to the embodiment described above, and various other embodiments may be implemented without departing from the scope of the present disclosure. For example, technical features in the present embodiment may be replaced or combined as appropriate. In addition, a technical feature in the present embodiment may be deleted as appropriate.

What is claimed is:

1. A martensitic stainless steel comprising:

0.20 mass %≤C≤0.60 mass %;

0.10 mass %≤N≤0.50 mass %;

14.00 mass %≤Cr≤17.00 mass %;

1.00 mass %≤Mo≤3.00 mass %;

0.20 mass %≤V≤0.40 mass %;

Si≤0.30 mass %;

Mn≤0.80 mass %;

P≤0.040 mass %;

S≤0.040 mass %;

Cu≤0.25 mass %;

Ni≤0.20 mass %; and a balance Fe with inevitable impurities, wherein a length of a compound group formed by connecting any one or more of metal carbide, metal nitride, and metal carbonitride is 80 μm or less.

2. The martensitic stainless steel according to claim 1, wherein the martensitic stainless steel is to be used for a part of an internal combustion engine.

3. The martensitic stainless steel according to claim 2, wherein the martensitic stainless steel is to be used for a fuel injection valve.

4. The martensitic stainless steel according to claim 2, wherein the martensitic stainless steel is to be used for a high-pressure pump.

* * * * *